US005817275A

United States Patent [19]

Ogawa et al.

[11] Patent Number: 5,817,275

[45] Date of Patent: Oct. 6, 1998

[54] STEEL PLATE HAVING EXCELLENT CORROSION RESISTANCE AND SULFIDE STRESS CRACKING RESISTANCE

[75] Inventors: Hiroyuki Ogawa; Hiroshi Tamehiro, both of Futtsu; Akihiko Takahashi, Kitakyushu; Hajime Ishikawa, Kimitsu; Takuya Hara, Futtsu, all of Japan

[73] Assignee: Nippon Steel Corporation, Tokyo, Japan

[21] Appl. No.: 408,655

[22] Filed: Mar. 21, 1995

[30] Foreign Application Priority Data

Mar. 22, 1994 [JP] Japan ..... 6-050910

[51] Int. Cl.[6] ..... C22C 38/20

[52] U.S. Cl. ..... 420/90; 420/93; 420/104

[58] Field of Search ..... 420/90, 93, 104

[56] References Cited

U.S. PATENT DOCUMENTS 4,153,454 5/1979 Toshihiko et al. .

FOREIGN PATENT DOCUMENTS

A-0205828 12/1986 European Pat. Off. .
A-0270952 6/1988 European Pat. Off. .
A-3311606 11/1993 European Pat. Off. .
55-128536 10/1980 Japan .
58-6961 1/1983 Japan .
60-89550 5/1985 Japan ..... 420/90
63-47352 2/1988 Japan .
63-18663 4/1988 Japan .

OTHER PUBLICATIONS

Key To Steels, 10 Edition 1974, W.Germany.

Patent Abstracts of Japan, vol. 17, No. 468 (C–1102(, Aug. 26, 1993 & JP–A–05 112844 (Kawasaki Steel Corp), May 1993.

Patent Abstracts of Japan, vol. 17, No. 426 (C–1094), Aug. 9, 1993 & JP–A–093243 (Kawasaki Steel), Apr. 16, 1993.

*Primary Examiner*—Deborah Yee
*Attorney, Agent, or Firm*—Kenyon & Kenyon

[57] ABSTRACT

A steel plate comprising by weight C: 0.01 to 0.1%, Si: 0.02 to 0.5%, Mn: 0.6 to 2.0%, P<0.020%, S<0.010%, O<0.005%, Cr: 0.1 to 0.5%, Cu: 0.1 to 1.0%, Al: 0.005 to 0.05%, and Ca: 0.0005 to 0.005%, Mn, S, and O having respective contents regulated to satisfy a requirement represented by the formula $Mn\times(S+O)\leqq 1.5\times10^{-2}$, and 0.01 to 0.1% in total of at least one member selected from the group consisting of Nb, V, and Ti with the balance consisting of Fe and unavoidable impurities. This steel plate has excellent corrosion resistance and sulfide stress cracking resistance in an environment containing carbon dioxide gas and hydrogen sulfide.

2 Claims, 2 Drawing Sheets

STEEL PLATE HAVING EXCELLENT CORROSION RESISTANCE AND SULFIDE STRESS CRACKING RESISTANCE

BACKGROUND OF THE INVENTION

1. Field of the Invention

The present invention relates to a steel plate, having a strength of about 40 to 55 kgf/mm$^2$, excellent carbon dioxide gas resistance and excellent sulfide stress cracking resistance, to be mainly used for line pipe applications in an environment containing carbon dioxide gas and a very small amount of hydrogen sulfide.

2. Description of the Prior Art

In recent years, natural gas resources containing carbon dioxide gas have been developed. The application of oil-well pipes and line pipes of conventional carbon steels and low-alloy steels to the development of the above resources has shown a lack of corrosion resistance in the pipes. Further, in recent years, natural gas resources containing a very small amount of hydrogen sulfide in addition to carbon dioxide gas have been developed. When the partial pressures of carbon dioxide gas and hydrogen sulfide are high, high alloy materials, such as stainless steels, are used, whereas when the partial pressures of carbon dioxide gas and hydrogen sulfide are low, steels having corrosion resistance and low alloy steels may be used.

In a natural gas environment containing carbon dioxide gas alone as the associated gas with hydrogen sulfide being absent, the form of corrosion is general corrosion and the occurrence of sulfide stress cracking is not observed. On the other hand, in an environment containing carbon dioxide gas in combination with hydrogen sulfide, the form of corrosion is general corrosion in combination with sulfide stress cracking.

Many techniques have already been disclosed with respect to low alloy line pipes for the purpose of imparting sulfide stress cracking resistance. For example, steels have been disclosed which have their sulfide stress cracking resistance improved by controlling the Mn, P, and C contents (Japanese Unexamined Patent Publication (Kokai) No. 58-6961), by adding Cu to regulate the hardness of a central segregated structure (Japanese Unexamined Patent Publication (Kokai) No. 63-47352), and by adding Ca or the like to control the morphology of inclusions (Japanese Unexamined Patent Publication (Kokai) No. 55-128536). Further, it is known that the addition of Cr is effective in reducing the rate of general corrosion in a carbon dioxide gas environment, and Japanese Examined Patent Publication (Kokoku) No. 53-18663 discloses the constituents of a Cr-containing steel, for an oil well, having excellent carbon dioxide gas resistance.

These existing techniques are either effective in improving the sulfide stress cracking resistance but ineffective against general corrosion caused by carbon dioxide gas, or effective against general corrosion caused by carbon dioxide gas but ineffective in improving the sulfide stress cracking resistance.

SUMMARY OF THE INVENTION

An object of the present invention is to provide a steel having properties sufficient to cope with the above problems of the prior art associated with the use of a steel in an environment containing a very small amount of hydrogen sulfide together with carbon dioxide gas.

Another object of the present invention is to provide a steel having properties which can solve the above problems of the prior art in an environment containing, together with carbon dioxide gas, hydrogen sulfide in an amount of, for example, not more than $1\times10^{-2}$ atm.

The present inventors have made various studies on surface properties of steels, such as general corrosion, hydrogen-induced cracking and sulfide stress cracking, in an environment containing, together with carbon dioxide gas, a very small amount of hydrogen sulfide. As a result, they have found that, in the above environment, the addition of a large amount of Cr as a constituent element of a steel results in increased general corrosion and deteriorated sulfide stress cracking resistance. They have further made studies on means for solving the above problem and, as a result, have found that, in order to lower the general corrosion in the above environment, the Cr content should fall within a particular range, that, in order to improve the sulfide stress cracking resistance, Cu should be added in a given amount range, and that, in order to improve the hydrogen-induced cracking resistance and the sulfide stress cracking resistance, the contents of Mn, S, and O should be regulated so as to satisfy a requirement that the value of Mn×(S+O) is a given value or less. This has led to the completion of the present invention directed to a steel which has excellent general corrosion resistance, hydrogen-induced cracking resistance and sulfide stress cracking resistance in an environment containing, together with carbon dioxide gas, a very small amount of hydrogen sulfide.

Specifically, the present invention provides a steel having the following composition.

The steel of the present invention comprises by weight C: 0.01 to 0.1%, Si: 0.02 to 0.5%, Mn: 0.6 to 2.0%, P<0.020%, S<0.010%, O<0.005%, Cr: 0.1 to 0.5%, Cu: 0.1 to 1.0%, Al: 0.005 to 0.05%, and Ca: 0.0005 to 0.005%, Mn, S, and O having respective contents regulated to satisfy a requirement represented by the formula $Mn\times(S+O)\leqq1.5\times10^{-2}$, and 0.01 to 0.1% in total of at least one member selected from the group consisting of Nb, V, and Ti with the balance consisting of Fe and unavoidable impurities.

The steel having the above composition has excellent corrosion resistance and sulfide stress cracking resistance in an environment containing carbon dioxide gas and hydrogen sulfide.

DESCRIPTION OF THE PREFERRED EMBODIMENT

As a result of detailed studies on general corrosion and cracking phenomena, such as hydrogen-induced cracking and sulfide stress cracking, in an environment containing carbon dioxide gas and a very small amount of hydrogen sulfide, the present inventors have found that, in order to reduce the corrosion rate of a steel plate in the above environment, the optimal amount of Cr added in a Cu-containing steel is in the range of from 0.1 to 0.5%. This is shown in FIG. 1.

Figure 1:
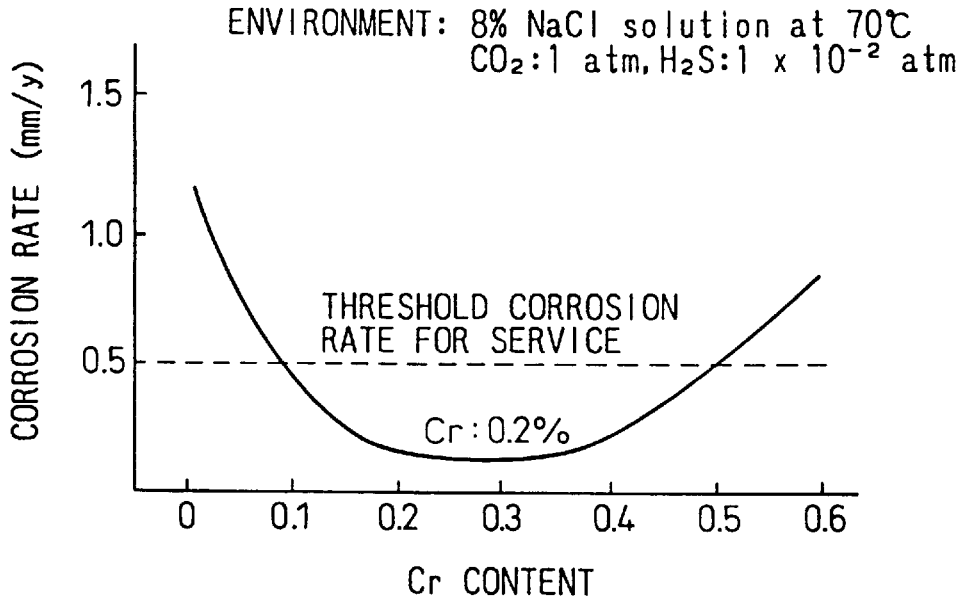
FIG. 1 is a diagram showing the effect of Cr content on the corrosion rate of a steel in an environment containing carbon dioxide gas and a very small amount of hydrogen sulfide.

FIG. 1 shows the relationship between the corrosion rate and the Cr content in the case where test materials prepared using steels having compositions of 0.05C—0.2Cu—Mn—Nb—Fe with Cr added in varied amounts were held for 168 hr in an atmosphere of a test vessel containing an 8% NaCl solution of 70° C. with an atmosphere controlled so as to have a $CO_2$ pressure of 1 atm and an $H_2S$ pressure of $1\times10^{-2}$ atom, and the corrosion rate of the test materials was determined. From the drawing, it is apparent that the corrosion rate increases both when the Cr content is high and when the Cr content is low, with the optimal amount of Cr added being in the range of from 0.1 to 0.5%.

Figure 2:
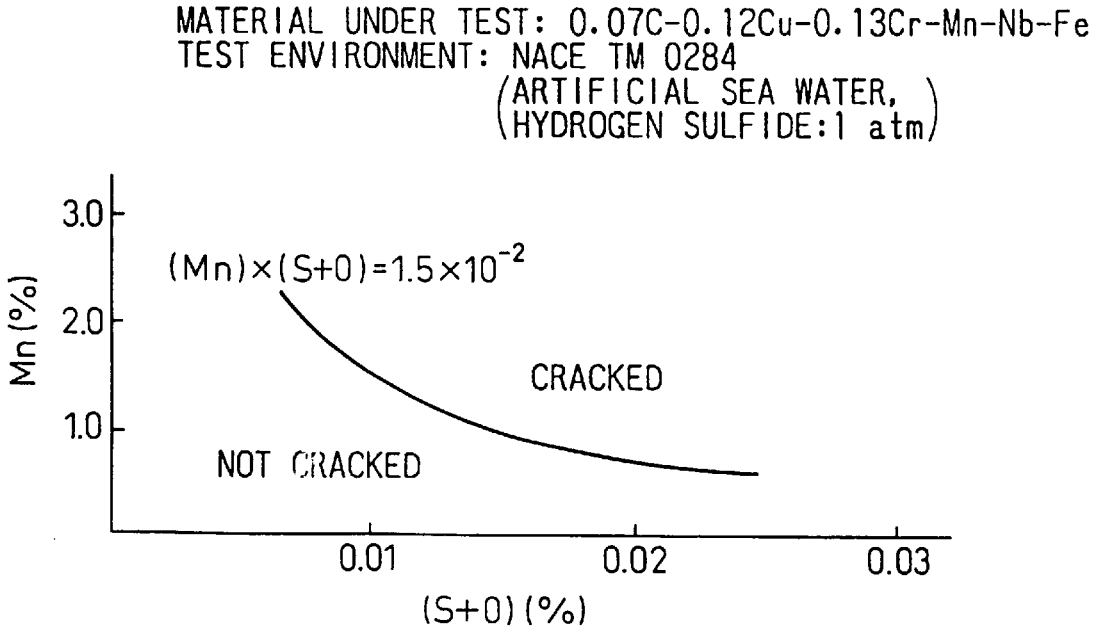
FIG. 2 is a diagram showing the effect of Mn and (S +O) contents of a steel on the hydrogen-induced cracking resistance.
Figure 3:
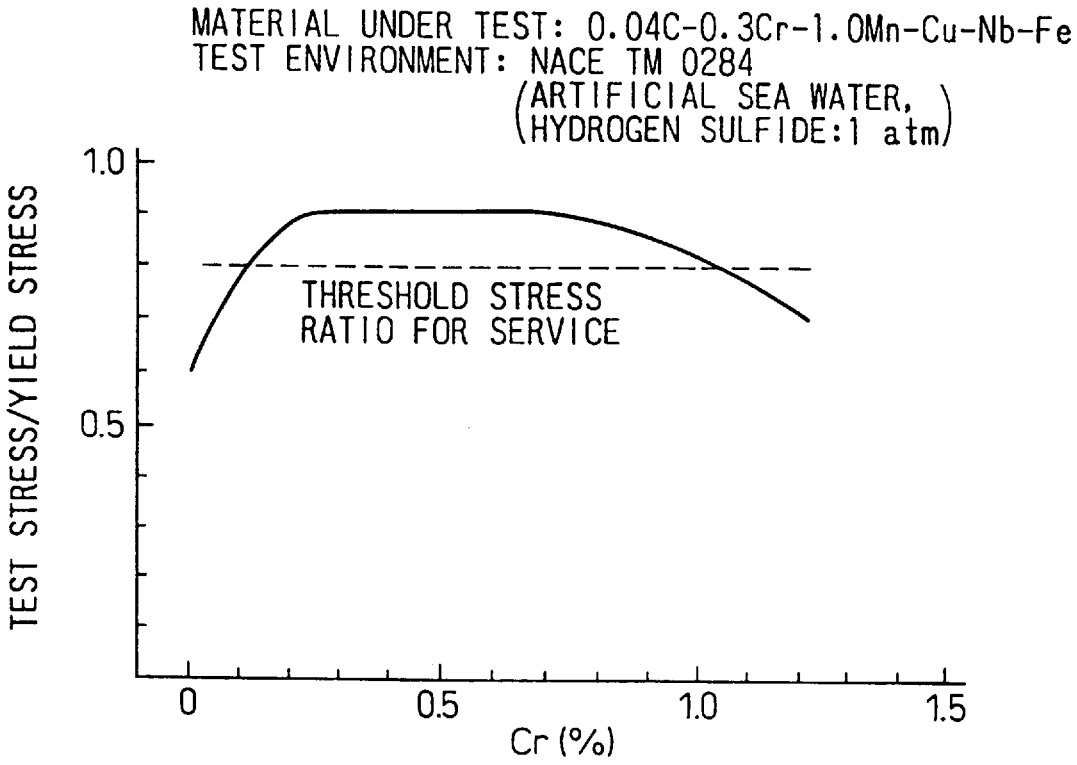
FIG. 3 is a diagram showing the effect of the addition of Cu on the sulfide stress cracking resistance of a steel.

Next, experiments (the results of which are shown in FIGS. 2 and 3) were carried out to reduce the hydrogen-induced cracking and sulfide stress cracking in the above environment.

FIG. 2 shows the results of tests on the evaluation for the effect of Mn, S, and O contents on hydrogen-induced cracking in a hydrogen sulfide environment. As can be seen from the drawing, when the product of the Mn content and the (S+O) content, Mn×(S+O), exceeds the threshold value $1.5\times10^{-2}$, giant elongated inclusions are formed and hydrogen-induced cracks occur from these inclusions. As is apparent from FIG. 2, the optimal value of Mn×(S+O) is $1.5\times10^{-2}$ or less.

The above test was carried out on a test material having a steel composition of 0.07C—0.12Cu—0.13C—Mn—Nb—Fe according to a hydrogen-induced cracking test specification NACE TM 0284. The test results demonstrate that the Mn content and the (S+O) content greatly influence the hydrogen-induced cracking.

FIG. 3 shows the results of experiments on the evaluation of the effect of Cu content on the threshold stress which creates sulfide stress cracking in a hydrogen sulfide environment for steels having a value of Mn×(S+O) of not more than $1.5\times10^{-2}$.

The above experiment was carried out on a test material having a steel composition of 0.04C—0.3Cr—1.0Mn—Cu—Nb—Fe in the same atmosphere as in FIG. 2 to determine the relationship between the threshold stress and the Cu content.

When the Cu content is in the range of from 0.1 to 1.0%, the test stress ratio which creates sulfide stress cracking (expressed in the ratio of test stress to yield stress) exceeds the threshold stress ratio 0.8, indicating good sulfide stress cracking resistance.

More specifically, the above experiment demonstrates that in order to impart corrosion sulfide stress cracking and hydrogen-induced cracking resistance to the steel plate in an environment containing carbon dioxide gas and a very small amount of hydrogen sulfide, it is necessary to incorporate as steel constituents 0.1 to 0.5% of Cr and 0.1 to 1.0% of Cu and, at the same time, to regulate the value of Mn×(S+O) to not more than $1.5\times10^{-2}$.

The reason for the limitation of constituents of a steel having excellent corrosion resistance and sulfide stress cracking in an environment containing carbon dioxide gas and hydrogen sulfide according to the present invention will now be described. The amounts of the following constituents are expressed in % by weight.

C: C is an element that is indispensable for ensuring strength and should be added in an amount of not less than 0.01%. When C is added in an amount exceeding 0.1% in order to accelerate the segregation of Mn in the stage of casting of the steel, there is a possibility that a fine low temperature transformed structure is formed. The formed low temperature transformed structure is likely to create hydrogen-induced cracking. For the above reason, the C content is in the range of from 0.01 to 0.1%.

Si: Si is added as a deoxidizer. When the Si content is less than 0.02%, the contemplated effect cannot be attained. On the other hand, when it exceeds 0.5%, the effect is saturated. For this reason, the Si content is limited to 0.02 to 0.5%.

Mn: Mn is an element that is indispensable for ensuring strength and toughness. When the Mn content is less than 0.6%, it is difficult to ensure the strength. On the other hand, as can be seen from FIG. 2, excess Mn, together with S and O, forms elongated inclusions during rolling, deteriorating the sulfide stress cracking. In order to prevent a deterioration in sulfide stress cracking, the requirement $Mn\times(S+O)\leqq1.5\times10^{-2}$ should be satisfied in view of FIG. 2. On the other hand, the addition of Mn in an amount exceeding 2.0% accelerates the formation of elongated inclusions, deteriorating the sulfide stress cracking resistance. For the above reason, the Mn content is limited to 0.6 to 2.0%.

P: P segregates at a site where Mn has segregated, particularly in the interface of the elongated inclusion and the matrix, deteriorating the sulfide stress cracking. Therefore, the P content should be limited. When the P content exceeds 0.02%, the deterioration in sulfide stress cracking is significant. For this reason, the P content is limited to not more than 0.02%.

S: S, together with Mn and O, forms elongated inclusions, deteriorating the sulfide stress cracking resistance. For this reason, as described above, the S content, as with the Mn and O contents, should be limited. When the S content exceeds 0.010%, the formation of elongated inclusions becomes significant. For this reason, the S content is limited to not more than 0.010%.

O: O, together with S and Mn, forms elongated inclusions, deteriorating sulfide stress cracking. Therefore, as described above, the O content, as with the Mn and S contents, should be limited. When the O content exceeds 0.005%, the formation of elongated inclusions becomes significant. For this reason, the O content is limited to not more than 0.005%.

Cr: Cr is a constituent element that is useful for inhibiting general corrosion in an environment containing carbon dioxide gas and hydrogen sulfide in which the steel of the present invention is to be used. It is, however, ineffective in ensuring the sulfide stress cracking resistance. The threshold corrosion rate of materials to be applied to the above environment is 0.5 mm/y, and, as shown in FIG. 1, the effect of inhibiting the general corrosion can be attained when the Cr content is less than 0.1%. On the other hand, in the case of a steel containing a combination of Cu with Cr, the addition of a large amount of Cr unfavorably increases the corrosion rate, and when the Cr content exceeds 0.5%, the corrosion rate exceeds the threshold corrosion rate. Therefore, the upper limit of the Cr content is 0.5%. For the above reason, the Cr content is limited to 0.1 to 0.5%.

Cu: Cu is an additive element that, as shown in FIG. 3, is useful for ensuring sulfide stress cracking resistance. The addition of a large amount of Cu results in deteriorated hot workability and weldability. Therefore, the upper limit of the Cu content is 1.0%. On the other hand, when the amount of Cu added is less than 0.1%, the contemplated effect cannot be attained. For this reason, the lower limit of the Cu content is 0.1%.

Al: Al is added as a deoxidizer. When the amount of Al added is less than 0.005%, the contemplated effect cannot be attained. On the other hand, when it exceeds 0.05%, the effect is saturated. For this reason, the amount of Al added is limited to 0.005 to 0.05%.

Ca: Ca is added in combination with Al to serve as a deoxidizer and, at the same time, as a desulfurizer. When the amount of Ca added is less than 0.0005%, the contemplated effect cannot be attained, while the addition of Ca in an amount exceeding 0.005% results in the formation of a giant oxide, deteriorating the sulfide stress cracking resistance. For this reason, the amount of Ca added is in the range of from 0.0005 to 0.005%.

Nb, V, Ti: Nb, V, and Ti are added alone or in combination of two or more for the purpose of ensuring the mechanical strength through precipitation hardening. When the total amount of these elements added is less than 0.01%, the contemplated effect cannot be attained, while the addition of these elements in a total amount exceeding 0.1% results in the formation of a giant oxide, deteriorating the sulfide stress cracking resistance. For this reason, the total amount of these elements is limited to 0.01 to 0.1%. The steel plate of the present invention may be produced by casting a slab of the alloy of the present invention by the conventional process comprising a combination of preparation of a steel by the melt process with casting and then hot-rolling the slab. A line pipe may be prepared from this steel plate by forming the above steel plate into a pipe using, for example, a UO press, and welding the joint to form a pipe. If necessary, the above pipe may be heat-treated to impart a strength of about 40 to 55 kgf/mm$^2$ to the pipe.

Oil-well pipes, line pipes, and the like produced from the resultant steel plates have excellent corrosion resistance and sulfide stress cracking resistance and, hence, can be used for natural gas resources containing a very small amount of hydrogen sulfide together with carbon dioxide gas. This renders the present invention very advantageous from the standpoint of industry.

EXAMPLE

Alloys of the present invention and comparative alloys having chemical compositions specified in Table 1 were tested for general corrosion, hydrogen-induced cracking, and hydrogen sulfide stress cracking by the same methods as in the tests shown in FIGS. 1 to 3.

TABLE 1

| Classification | No. | Chemical ingredients (wt%) C | Si | Mn | P | S | Cr | Cu | Nb | V | Ti | Al | Ca | O | Mnx (S + O) | Corrosion (1) (mm/y) | Hydrogen-induced cracking (2) | sulfide stress cracking(3) |
|---|---|---|---|---|---|---|---|---|---|---|---|---|---|---|---|---|---|---|
| Steel of inv. | 1 | 0.04 | 0.30 | 1.1 | 0.008 | 0.006 | 0.25 | 0.23 | 0.06 | — | — | 0.03 | 0.001 | 0.0021 | $8.9 \times 10^{-3}$ | 0.18 | Not cracked | Not cracked |
| | 2 | 0.07 | 0.22 | 0.8 | 0.007 | 0.007 | 0.42 | 0.33 | 0.03 | 0.03 | — | 0.02 | 0.002 | 0.0020 | $7.2 \times 10^{-3}$ | 0.38 | Not cracked | Not cracked |
| | 3 | 0.02 | 0.22 | 1.6 | 0.007 | 0.002 | 0.18 | 0.68 | 0.03 | | 0.03 | 0.03 | 0.001 | 0.0019 | $6.2 \times 10^{-3}$ | 0.34 | Not cracked | Not cracked |
| | 4 | 0.05 | 0.27 | 1.4 | 0.006 | 0.005 | 0.28 | 0.18 | — | 0.07 | 0.02 | 0.03 | 0.002 | 0.0022 | $1.0 \times 10^{-2}$ | 0.20 | Not cracked | Not cracked |
| | 5 | 0.04 | 0.23 | 1.2 | 0.008 | 0.009 | 0.13 | 0.18 | 0.05 | — | — | 0.02 | 0.001 | 0.0024 | $1.3 \times 10^{-2}$ | 0.33 | Not cracked | Not cracked |
| | 6 | 0.03 | 0.21 | 1.2 | 0.007 | 0.005 | 0.27 | 0.42 | — | 0.06 | — | 0.03 | 0.002 | 0.0017 | $8.0 \times 10^{-3}$ | 0.27 | Not cracked | Not cracked |
| | 7 | 0.04 | 0.22 | 0.9 | 0.007 | 0.004 | 0.32 | 0.23 | — | — | 0.04 | 0.03 | 0.002 | 0.0016 | $5.0 \times 10^{-3}$ | 0.15 | Not cracked | Not cracked |
| Comp. steel | 8 | 0.08 | 0.21 | 1.8 | 0.008 | 0.007 | —* | —* | 0.04 | 0.03 | — | 0.03 | 0.001 | 0.0019 | $1.6 \times 10^{-2}$* | 1.32 | Somewhat cracked | Cracked |
| | 9 | 0.19* | 0.18 | 1.9 | 0.007 | 0.015* | —* | 0.13 | — | — | — | 0.03 | — | 0.0045 | $3.7 \times 10^{-2}$* | 1.88 | Cracked | " |
| | 10 | 0.15* | 0.20 | 1.6 | 0.008 | 0.012* | 0.34 | 0.25 | 0.05 | — | — | 0.02 | — | 0.0032 | $2.4 \times 10^{-2}$* | 0.86 | " | " |
| | 11 | 0.06 | 0.22 | 1.7 | 0.007 | 0.008 | 0.8* | —* | 0.04 | — | — | 0.03 | 0.001 | 0.0022 | $1.7 \times 10^{-2}$* | 0.60 | Somewhat cracked | " |

(1)8% NaCl solution, 70° C/$CO_2$: 1 atm, $H_2S$: $1 \times 10^{-2}$ atm
(2)NACE TM 0284 $H_2S$: 1 atm
(3)NACE TM 0284 test stress/yield stress = 0.8
(4)*outside the scope of the present invention As is apparent from FIG. 1, the steels of the present invention had a low corrosion rate and suffered neither hydrogen-induced cracking nor sulfide stress cracking.

By contrast, steel No. 8 among the comparative steels was free from Cr and, hence, had much higher corrosion rate than the steels of the present invention. Further, since it had a value of Mn×(S+O) somewhat higher than the upper limit specified in the present invention, some materials under test suffered from hydrogen-induced cracking. Furthermore, since it contained Cu, sulfide stress cracking occurred.

For steel No. 9, the contents of C and S are high and, consequently, the value of Mn×(S+O) is high. Further, Cr was not added. These resulted in a remarkably high corrosion rate and, at the same time, hydrogen-induced cracking and sulfide stress cracking.

For steel No. 10, the Cr and Cu contents fall within the respective content ranges specified in the present invention. However, the C and S contents are high and, consequently, the value of Mn×(S+O) is also high. This resulted in high corrosion rate and, at the same time, both hydrogen-induced cracking and sulfide stress cracking.

For steel No. 11, the Cr content is high, and Cu was not added. This resulted in high corrosion rate and, at the same time, sulfide stress cracking. Further, since the value of Mn×(P+O) somewhat exceeded the upper limit of the value range specified in the present invention, some materials under test gave rise to hydrogen-induced cracking.

According to the present invention, it has become possible to provide a steel having excellent corrosion resistance, hydrogen-induced cracking resistance, and sulfide cracking resistance in an carbon dioxide gas environment containing a very small amount of hydrogen sulfide.

We claim:

1. A steel plate having excellent corrosion resistance and sulfide stress cracking resistance in an environment containing carbon dioxide gas and hydrogen sulfide, consisting essentially of by weight C: 0.01 to 0.1%, Si: 0.02 to 0.5%, Mn: 0.6 to 2.0%, P<0.020%, S<0.010%, O<0.005%, Cr: 0.1 to 0.5%, Cu: 0.1 to 1.0%, Al: 0.005 to 0.05%, and Ca: 0.0005 to 0.005%, Mn, S, and O having respective contents regulated to satisfy a requirement represented by the formula $Mn\times(S+O)\leqq 1.5\times10^{-2}$, and 0.01 to 0.1% in total of at least one member selected from the group consisting of Nb, V, and Ti with the balance consisting of Fe and unavoidable impurities.

2. A steel plate according to claim 1 containing 0.002 to 0.010% S.

* * * * *